US006695620B1

(12) United States Patent
Huang

(10) Patent No.: US 6,695,620 B1
(45) Date of Patent: Feb. 24, 2004

(54) CABLE END CONNECTOR WITH UNIVERSAL JOINT

(76) Inventor: Yea Yen Huang, No. 12, Alley 70, Sec. 1, Chung Hua Road, Tocheng City, Taipei Hsien (TW)

( * ) Notice: Subject to any disclaimer, the term of this patent is extended or adjusted under 35 U.S.C. 154(b) by 0 days.

(21) Appl. No.: 10/358,215

(22) Filed: Feb. 5, 2003

(51) Int. Cl.[7] ..... H01R 39/00
(52) U.S. Cl. ..... 439/11; 439/17
(58) Field of Search ..... 439/11, 13, 17, 439/18, 19, 23, 31

(56) References Cited

U.S. PATENT DOCUMENTS 861,468 A * 8/1907 Kreinsen
1,981,854 A * 11/1934 Comiskey ..... 173/324
2,511,772 A * 6/1950 Finizie ..... 173/332
4,382,647 A * 5/1983 Paley ..... 339/7
4,959,021 A * 9/1990 Byrne ..... 439/310
5,425,645 A * 6/1995 Skovdal et al. ..... 439/23
5,676,568 A * 10/1997 Weber ..... 439/694
5,735,707 A * 4/1998 O'Groske et al. ..... 439/466

* cited by examiner

*Primary Examiner*—Alexander Gilman
(74) *Attorney, Agent, or Firm*—Troxell Law Office PLLC

(57) ABSTRACT

The present invention relates to a cable assembly having a universal joint so as to rotate the connector thereof through X and Y directions. Upper and lower housings of the connector is provided with traverse bearings. A front edge of a front rotating arm is provided with assembled traverse shafts. A rear portion of the front rotating arm is provided with a slot in which axial holes are defined. By this arrangement, the front rotating arm and the rear rotating arm can each can rotate freely on a plane thereby provide two dimensional rotations. Conductive wires of the cable routes through the front rotating arm and the rear rotating arm and finally electrically connected to the connector. As a result, a cable assembly with a universal rotational connector is provided.

3 Claims, 4 Drawing Sheets

CABLE END CONNECTOR WITH UNIVERSAL JOINT

FIELD OF THE INVENTION

The present invention relates to a cable end connector, and more particularly to a cable end connector with a universal joint, which can be rotated through any desired angle so as to make a proper connection. The connector can be rotated and positioned in a desired angle so as not to block an adjacent connecting port thereby facilitating efficient usage of limited space. In addition, with the rotational feature of the connector, cables connected to the connecting ports will stay intact without damage thereby ensuring proper and stable signal transmission therethrough.

DESCRIPTION OF THE RELATED ART

With an everlasting development of the computer technologies so as to meet the demanding requirements from the market as well as competition, peripheral equipments for computer has been expanded tremendously. In addition, with the network become more and more popular, interconnections between the portable computer (notebook), personal computer (desktop) and server become more and more complexity.

There are a plurality of peripheral equipments which can be used with the computers, namely printer, scanner, video monitor, external disk driver, keyboard, mouse, modem, card reader, digital camera, outer box, and hub. No mater of its dimension of those equipment, it has to be connected to the computer so as to perform its intended functions. As such, it becomes a challenge for providing an easy connection as well as power between the peripheral equipments and the computers.

In general, each connector has its own shape, for example, the USB has a rectangular interface, IEEE 1394 has a polygonal interface, PS2 features a round interface. The existing interfaces, i.e. connecting hub, for the peripheral equipments serve an adequate bridge between the computers and the peripheral equipments. The big function of the existing hub is to interconnect a plurality of computers and equipments simultaneously. As such, through the hub, those peripheral equipments can be easily connected to a host computer after each of the peripheral equipments are connected to the hub. Accordingly, the hub play a key role in interconnection between the computer and the peripheral equipments.

The main feature of the USB, IEEE 1994 and PS2 is that it includes five conductive wires in the cable. Two of the conductive wires are used for signal transmission, the other two conductive wires transmits power, namely 500 mA of 5V. The last conductive wire serves for ground. Accordingly, it can be readily appreciated that those three connectors can transmit both signals as well as power simultaneously. Accordingly, while the peripheral equipments are connected through the USB, IEEE 1394, and PS2, the equipments are also powered. As a result, the USB, IEEE 1394 and PS2 have become a standard connecting ports for desktop, notebook and HUB for its convenience.

However, the interfacing contour of USB, IEEE 1394 and PS2 has a certain orientation which ensures mating between two mated connectors and mismatch between different connectors. Accordingly, each of the USB, IEEE 1394 and PS2 has to be inserted along a certain direction. If the orientation of the connector is not suitably arranged, not only will it badly effect the insertion of adjacent connectors, but will also create a mess on its connected cable. Once the equipment is pushed against a wall, the connectors might be damaged. Accordingly, it is preferable to make those connector rotationally along an X and Y direction. The above mentioned problem can be easily solved.

DETAILED DESCRIPTION OF PREFERRED EMBODIMENTS

The present invention relates to a cable assembly having a universal joint so as to rotate the connector thereof through X and Y directions. The cable assembly made in accordance present invention is designed to solve the defects mentioned above. Upper and lower housings of the connector is provided with traverse bearings. A front edge of a front rotating arm is provided with assembled traverse shafts. A rear portion of the front rotating arm is provided with a slot in which axial holes are defined. By this arrangement, the traverse shafts of the front rotating arm and an axial shaft of a rear rotating arm provide two different rotations. Conductive wires of the cable can be routed through the rear rotating arm and the front rotating arm and finally electrically connected to the connector, which can rotate to the desired angle.

Figure 1:
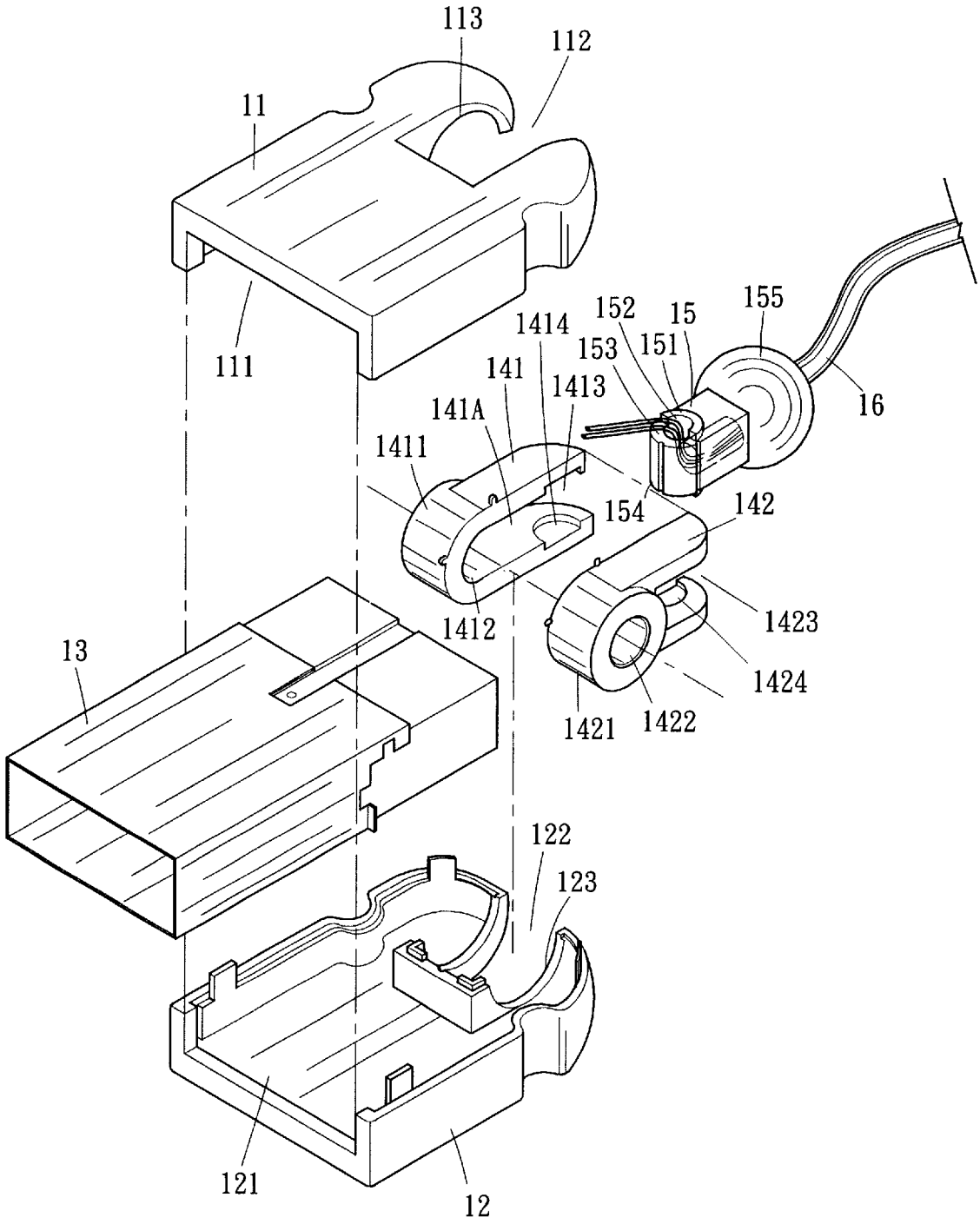
FIG. 1 is an exploded view of a universal adaptor in accordance with the present invention.
Figure 2:
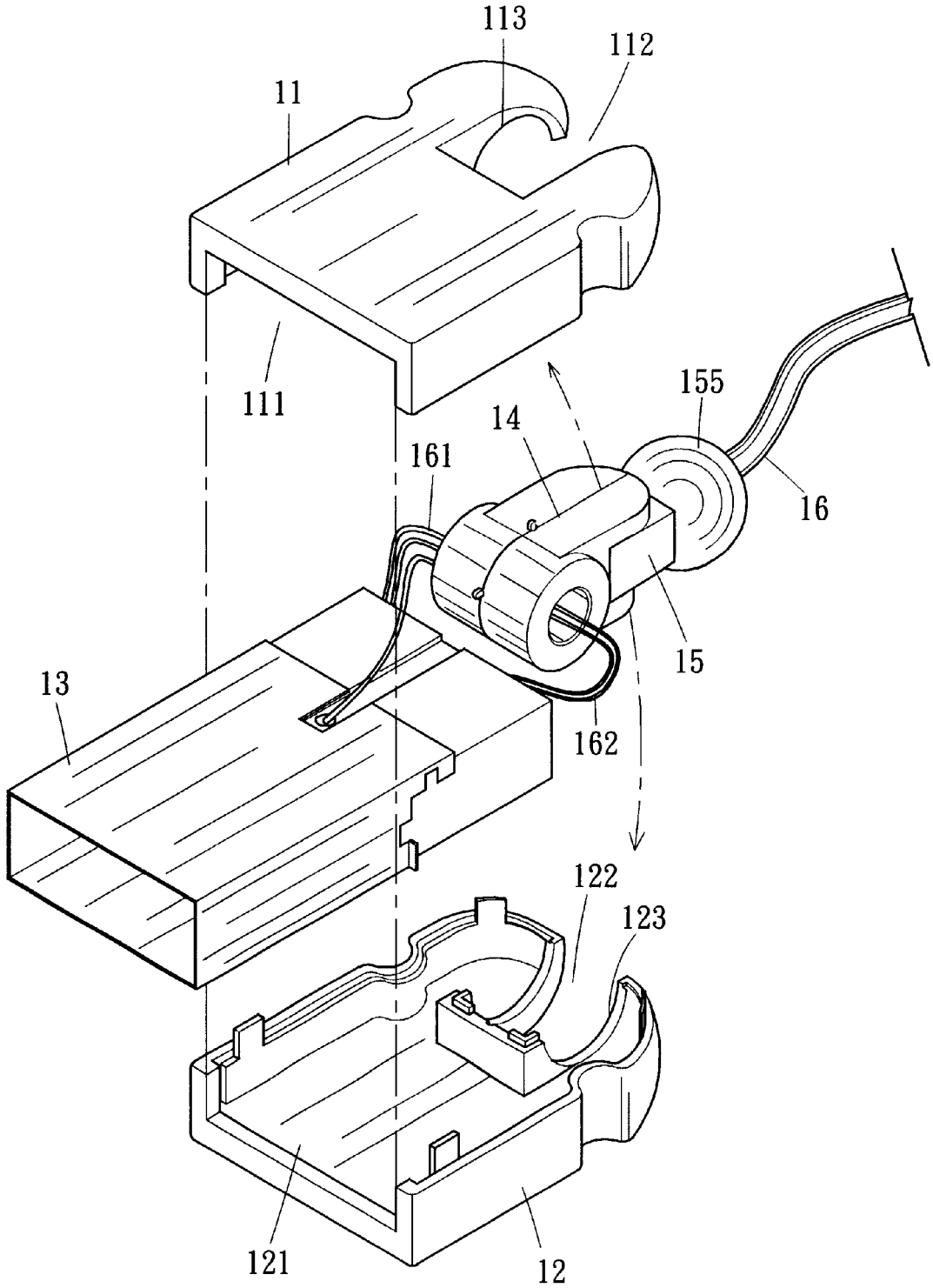
FIG. 2 is an assembled view.
Figure 3:
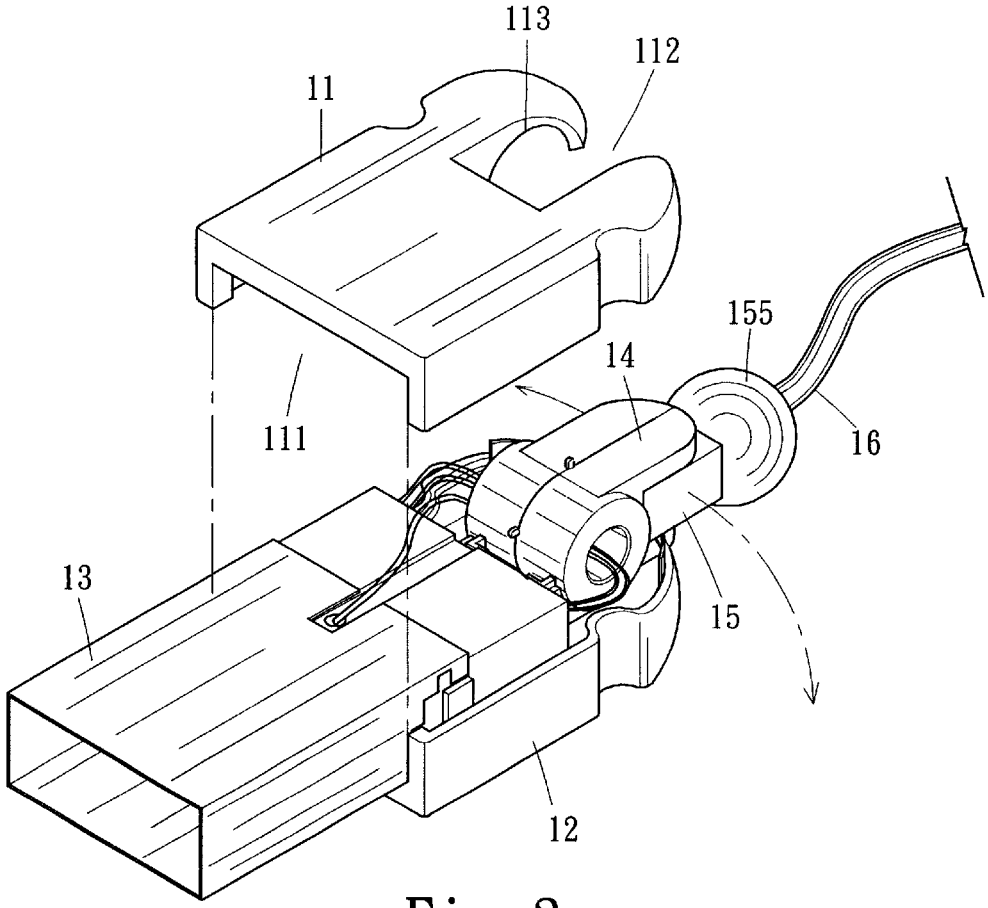
FIG. 3 is partially assembled view of FIG. 2.

Referring to FIGS. 1, 2 and 3, the cable end connector assembly 1 in accordance with the present invention includes a upper housing 11, a lower housing 12, a connector 13, a front rotating arm 14, a rear rotating arm 15 and cable 16. The upper housing 11 and the lower housing 12 defines receiving slots 111, 121 for receiving the connector 13. The tail is provided with opening 112 (122). The opening is provided with semi-circular bearings 113, 123.

The front rotating arm 14 is configured by a pair of arm elements 141, 142. The front rotating arm 14 has a central passage 141A along with is provided with traverse shafts 1411, 1421. The shafts 1411, 1412 each has a through hole 1412, 1422 which is in communication with the central passage 141 A. The arm elements 141, 142 are provided with slots 1413, 1423, respectively. The slots 1413 and 1423 are provided with axial hole 1414, 1424, respectively.

The rear rotating arm 15 is connected to the cable 16. The front of the rear rotating arm 15 is provided shaft 151 with respect to the axial holes 1414, 1424. The shaft 151 has a through hole 152 and shoulders 153, 154. The rear rotating arm 15 is further provided with a ball 155 adjacent the cable 16 for retaining the cable 16.

The shaft 151 of the rear rotating arm 15 can be assembled into the holes 1414, 1424 of the slots 1413, 1423 of the front rotating arm 14. Then the traverse shaft 1411, 1421 of the front rotating arm 14 is assembled into the semi-circular bearing 113, 123 such that the connector 13 is disposed in the receiving slots 111, 121. Afterward, the conductive wires 161, 162 of the cable 16 extend through the through hole 152 of the rear rotating arm 15. The conductive wires 161, 162 further extend through the central passage 141A and further connected to the connector 13 through the through holes 1412, 1422.

Figure 4:
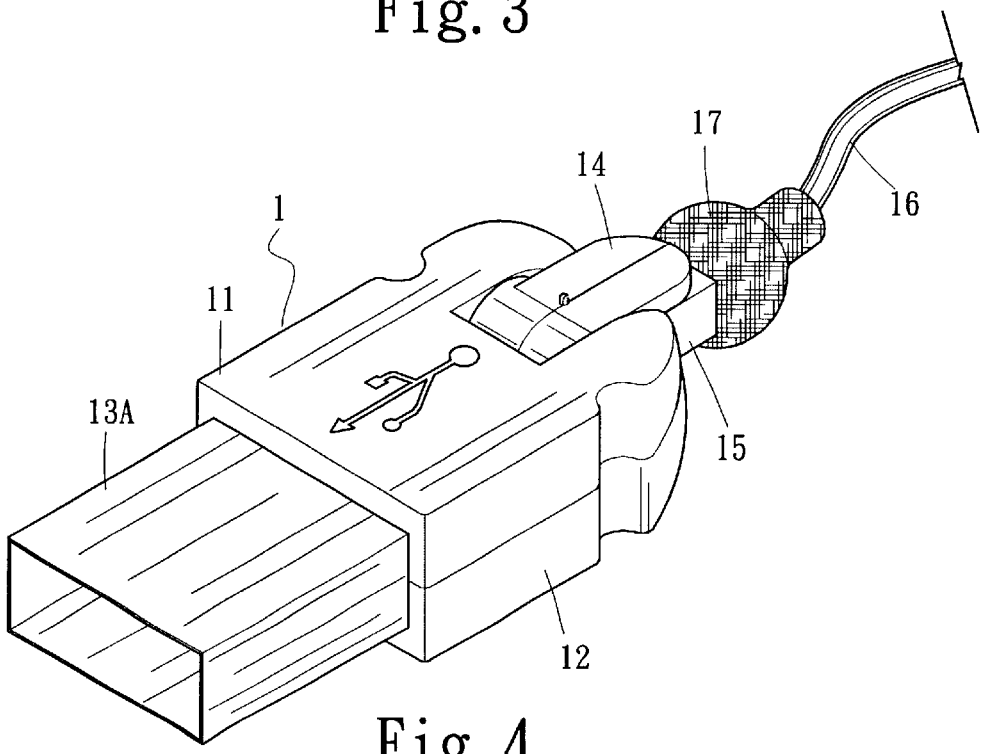
FIG. 4 is a second embodiment in accordance with the present invention.
Figure 5:
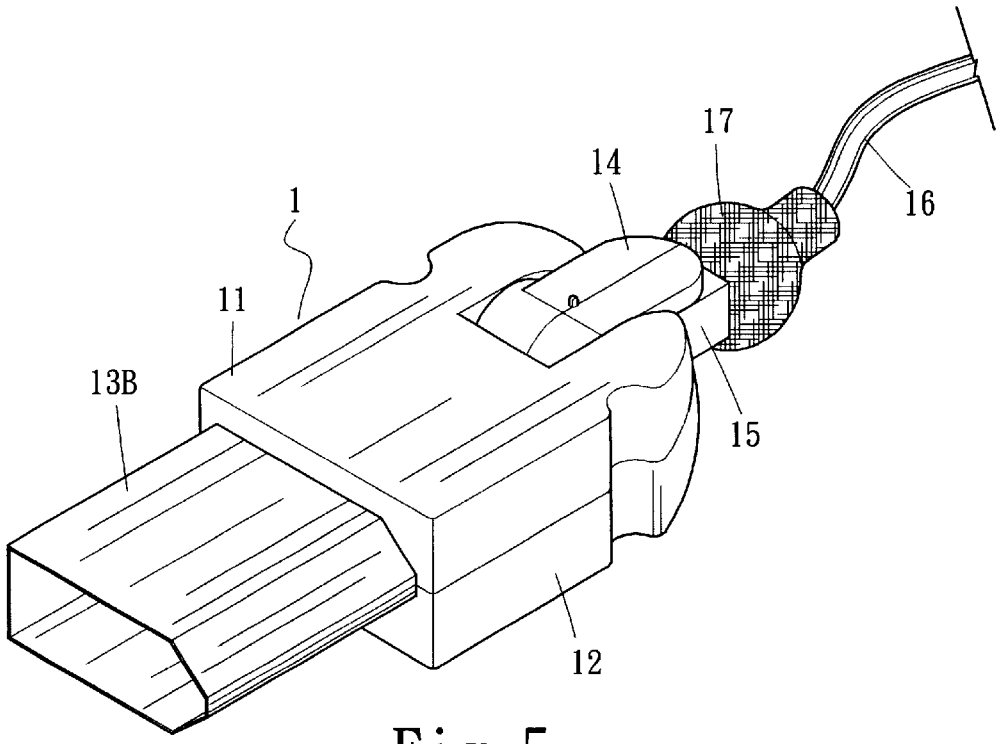
FIG. 5 is a third embodiment in which a IEEE 1394 connector is provided with the universal joint.
Figure 6:
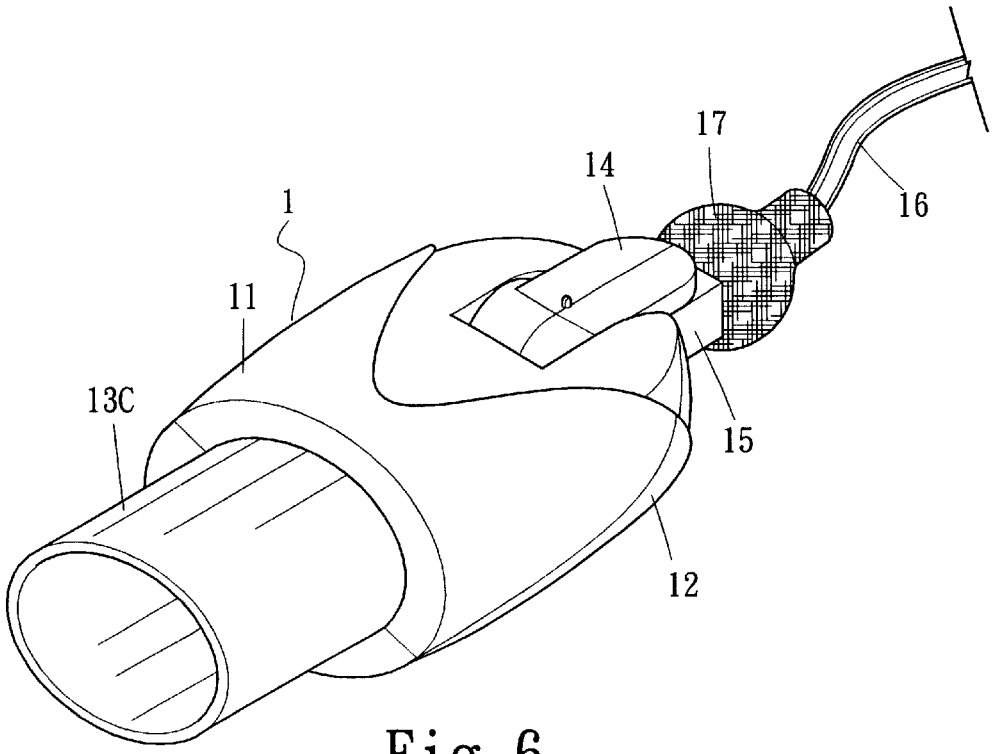
FIG. 6 is a fourth embodiment in which a PS2 connector is provided with the universal joint.

As shown in FIGS. 4 and 5, the connector 13 can be a USB 13A, an IEEE 1394 connector 13B, a PS2 connector 13C or other suitable connector. After the connector 13 is disposed in the receiving slots 111, 121, the upper housing 11 and the lower housing 12 are assembled together.

By this arrangement, the front rotating arm 14 and the rear rotating arm 15 can rotate freely in the opening 112, 122 of the top housing 11 and the lower housing 12, and the slots 1413, 1324 of the front rotating arm 14.

On the other hand, the ball 155 arranged between the rear rotating arm 15 and the cable 16 can be inserted molded 17 together. On an alternative, the merging portion between the rear portion of the rear rotating arm 15 and the cable 16 can be covered with packaging housing.

In conclusion, by the provision of the present invention, the cable end connector assembly 1, which can be embodied with a USB connector, an IEEE 1394 connector, and PS2, or other connectors, can conveniently rotate along the X and Y axis thereby overcoming the problems encountered by the prior arts. The user can easily elect an insertion by rotating the connector. Accordingly, even within a narrowed space, the cable will not be twisted, the socket or connector will not be damaged due to twisted cable. Consequently, the unstable signal transmission resulted therefrom can be completely avoided.

What is claimed is:

1. A cable assembly, including a upper housing, a lower housing, a connector, a front rotating arm, a rear rotating arm, and a cable, the upper housing and lower housing provided with receiving slots for received the connector therein, rear portions of the upper and lower housings being provided with opening having semi-cicular bearings thereof, the front rotating arm being configured by a pair of arm elements and defining a central passage therethrough, the front rotating arm being provided with a pair of traverse shafts each having a through hole which is in communication with the central passage of the front rotating arm, the arm elements being provided with slots in rear end and each being provided with axial hole, respectively, the rear rotating arm being connected with the cable at a rear end thereof, a front portion of the rear rotating arm being provided with a shaft with respect to the axial hole of the rear rotating arm, the rear rotating arm having a through hole, and have shoulders thereof, the rear rotating arm further including a ball adjacent to the cable for retaining the cable thereof, characterized in that the rear rotating arm can be assembled to the front rotating arm by the arrangement between the through hole of the front rotating arm and the shaft located in the front of the rear rotating arm, then the traverse shafts of the front rotating arm can be assembled into the traverse bearings of the upper and lower housings, and the connector is disposed into the receiving slot, conductive wires of the cable route through the through hole of the rear rotating arm, and guided through the central passage of the front rotating arm, and finally electrically connected to the connector, by this arrangement of the front rotating arm and the rear rotating arm, the connector can be rotated and positioned at any desired angular position.

2. The cable assembly as recited in claim 1, wherein the connector can be a USB connector, an IEEE 1394 connector, and a PS2 connector or any kind of connector.

3. The cable assembly as recited in claim 1, wherein the ball arranged between the rear rotating arm and the cable can be inserted molded, or the merging portion between the rear portion of the rear rotating arm 15 and the cable 16 can be covered with packaging housing.

* * * * *